US005839649A

United States Patent [19]

Clark

[11] Patent Number: 5,839,649

[45] Date of Patent: Nov. 24, 1998

[54] TRAPEZOIDAL CARTONS WITH AN INNER PARTITION

[75] Inventor: Mitchell Clark, Great Neck Long Island, N.Y.

[73] Assignee: Union Camp Corporation, Wayne, N.J.

[21] Appl. No.: 878,303

[22] Filed: Jun. 18, 1997

[51] Int. Cl.[6] ..... B65D 5/00

[52] U.S. Cl. ..... 229/114; 229/120.18

[58] Field of Search ..... 229/114, 120.18, 229/120.11

[56] References Cited

U.S. PATENT DOCUMENTS

| | | | |
|---|---|---|---|
| 2,175,600 | 12/1939 | Greco | 229/120.18 X |
| 2,625,315 | 3/1953 | Fehrenkamp | 229/114 X |
| 2,686,002 | 8/1954 | Inman | 229/114 |
| 2,965,278 | 12/1960 | Phillips | 229/120.18 |
| 5,088,641 | 2/1992 | Shepard | 229/120.18 X |
| 5,366,141 | 11/1994 | Stone | 229/120.18 X |

*Primary Examiner*—Allan N. Shoap
*Assistant Examiner*—Tri M. Mai
*Attorney, Agent, or Firm*—Richard R. Muccino

[57] ABSTRACT

The present invention is directed to a one piece trapezoidal carton with an inner partition for packaging an article. The one piece trapezoidal carton with an inner partition comprises a trapezoidal carton section having (a) trapezoidal front and back wall panels; (b) first and second trapezoidal side wall panels connecting the front and back wall panels; (c) a rectangular bottom panel closing the bottom of the carton; (d) a rectangular top panel including a top closing flap for closing the top of the carton; and (e) a trapezoidal glueable side panel, having a first and second side, attached to the inside of the first side wall panel. The first side of the trapezoidal glueable side panel extends from the back wall panel. The one piece trapezoidal carton with an inner partition also comprises an inner partition section having (a) a trapezoidal center partition; (b) a pair of trapezoidal cradling partitions, each extending from a side of the center partition; (c) first and second trapezoidal supporting partitions, each extending from a side of one of the trapezoidal cradling partitions; and (d) a trapezoidal glueable partition, attached to the inside of the second side wall panel, extending from a side of the second trapezoidal supporting partition. A side of the first trapezoidal supporting partition in the inner partition section extends from the second side of the trapezoidal glueable side panel in the trapezoidal carton section to form the one piece carton. The present invention is also directed to a one piece blank of foldable sheet material cut and scored so that it is divided into a series of connected wall forming panels which when assembled provides the inventive one piece trapezoidal carton with an inner partition for packaging an article.

7 Claims, 2 Drawing Sheets

TRAPEZOIDAL CARTONS WITH AN INNER PARTITION

FIELD OF THE INVENTION

The present invention is directed to a one piece trapezoidal carton with an inner partition for packaging an article. The one piece trapezoidal carton with an inner partition comprises a trapezoidal carton section having (a) trapezoidal front and back wall panels; (b) first and second trapezoidal side wall panels connecting the front and back wall panels; (c) a rectangular bottom panel closing the bottom of the carton; (d) a rectangular top panel including a top closing flap for closing the top of the carton; and (e) a trapezoidal glueable side panel, having a first and second side, attached to the inside of the first side wall panel. The first side of the trapezoidal glueable side panel extends from the back wall panel. The one piece trapezoidal carton with an inner partition also comprises an inner partition section having (a) a trapezoidal center partition; (b) a pair of trapezoidal cradling partitions, each extending from a side of the center partition; (c) first and second trapezoidal supporting partitions, each extending from a side of one of the trapezoidal cradling partitions; and (d) a trapezoidal glueable partition, attached to the inside of the second side wall panel, extending from a side of the second trapezoidal supporting partition. A side of the first trapezoidal supporting partition in the inner partition section extends from the second side of the trapezoidal glueable side panel in the trapezoidal carton section to form the one piece carton. The present invention is also directed to a one piece blank of foldable sheet material cut and scored so that it is divided into a series of connected wall forming panels which when assembled provides the inventive one piece trapezoidal carton with an inner partition for packaging an article.

DESCRIPTION OF THE BACKGROUND

Many types of cartons for packaging articles are known. However, these cartons have not been suitable for use when a trapezoidal shaped carton is desired along with a cradling device inside the carton to hold the article in place. Such an arrangement generally requires the use of two different components, a trapezoidal carton and a separate cradling device.

U.S. Pat. No. Re. 28,530 (D'Alessio) discloses a shadow box style (partially open faced) carton formed from a single paperboard blank with end closure flaps and a partially open front or top through which the merchandise may be viewed (see FIG. 1). A portion forming a panel extends inwardly in a diagonal plane from a hinged connection at one side of the 2; opening of the carton and connects to an inside wall remote from the hinged connection at the side of the opening to leave space for merchandise (see FIG. 2). The diagonal panel may have an extension for cradling the merchandise to better support and retain the merchandise in the carton (see FIG. 6). More specifically, D'Alessio discloses a rectangular carton having a back wall, adjoining side walls hinged to the back wall, a front wall hinged to the side walls having an opening between the top and bottom edges, end closure flaps hinged to the sides and to one of the back or front walls, and a single shadow forming panel hinged to a side wall at a side of the front wall opening which is adjacent the connection of the front wall and one side wall. The shadow forming panel lies in a vertical plane extending from its hinged connection with the side wall diagonally inwardly of the front wall and in the direction of the opposite side wall and the back wall. The inner margin of the shadow forming panel is reversely folded to provide a panel in a plane extending diagonally relative to the plane of the front wall and in the direction of the back wall and the side wall to which the shadow forming panel is hinged. Glue tabs are provided for securing the terminus to the inside face of the back wall intermediate the side edges of the back wall providing space between the reversely folded panel portion and the opposite side wall of the carton for accommodating an article. The space for the article is bounded by the reversely folded inner margin portion of the shadow forming panel, the opposite side wall, and the interconnecting portion of the back wall. FIGS. 11–13 illustrate a tapered configuration or shape of the shadow box style carton having a shadow forming panel extending inwardly in a diagonal plane from one side of the opening of the carton to a remote inside wall.

U.S. Pat. No. 175,732 (Munson) discloses a paper box (ice cream and oyster box) consisting of single blank of paper folded into the shape of an inverted truncated pyramid. The bottom of the box is formed from a flap having parallel sides and right-angular corners. The bottom end of the box is closed with tight seams or joints.

U.S. Pat. No. 203,899 (Dunn) discloses a blank for making a grocer's dish (for juicy and perishable merchandise) cut from a sheet material, having three full-sized sides, flaps to form a fourth side, and a vertical lap-joint, lappets to connect the sides of the three full-sized sides with the corresponding sides of the full-sized bottom, and a lappet to overlap the bottom edges of the overlapping flaps.

U.S. Pat. No. 1,950,111 (Heim) discloses a foldable container (for use as an ornamental flower pot cover, which may be hexagonal). The foldable container comprises a wall having a plurality of tapered sides hinged at their edges and a means for connecting the ends to form a continuous wall, a bottom section hinged to the bottom edge of one of the sides of the wall section so as to collapse within the container, a pair of substantially triangular marginal flaps hinged to the bottom section on opposite sides, and a plurality of substantially rectangular marginal flaps hinged to the bottom section between the triangular flaps. All flaps extend upwardly from the bottom section with the edges of the adjacent flaps forming with the bottom section a tapering cup wedged between and supported from the walls.

U.S. Pat. No. 2,237,706 (Islieb) discloses a flat one-piece blank for a display basket (for toilet articles) having a series of substantially aligned folds including a front fold, side folds projecting from opposite sides of the front fold, and a back fold projecting from the outer side edge of one of the folds. The front, side, and back folds form the front, side, and back walls of the basket, respectively. A locking tongue and slot connection between the outer end of the back fold and the side fold secures the blank in basket form. Reinforcing side folds project from the top edges of the side folds and front fold and secure their respective folds along the fold lines. Supplemental bottom folds project from the free top edges of each of the reinforcing side folds and secure their respective folds along the fold lines. The supplemental bottom folds each have a dimension substantially corresponding to the bottom of the basket. A bottom fold projects from the lower edge of the front fold opposite the reinforcing-side fold. A tuck projects from the lower edge of the bottom fold for insertion in the folded structure to hold the bottom structure in place. The back fold has a rigid and integral extension projecting upwardly from the upper portion above the upper edge of the basket to a distance at least equal to the depth of the basket.

U.S. Pat. No. 4,109,786 (Roccaforte et al.) discloses a carton to hold round cylindrical articles in an angular position to prevent slippage and rotation which would move the front of the cylindrical article out of registration with the display opening in the front of the carton. The carton holds the cylindrical article against an area covered with a substance which provides a friction surface in contact with the cylindrical article. More specifically, Roccaforte et al. discloses a rectangular display carton having a front and back panel and an insert. The front panel has an aperture to display the contents of the carton and the insert is adapted to contact and provide restraint for a smooth cylindrical object to prevent rotation out of registration with the opening in the carton. The insert comprises a central panel, a series of at least three panels connected by parallel vertical hinge lines on each side of the central panel, and elongated offset strut panels formed in the second of the series of panels. The strut panels have article engaging edges and a friction surface applied to the inner surface of the central panel for contacting the cylindrical article to prevent rotation.

U.S. Pat. No. 4,948,035 (Wischoff) discloses an end closure arrangement for a hexagonal container that comprises separate closure flaps foldably joined to each container side wall panel at one end of the container. The flaps include a pair of inner closure flaps, a pair of first intermediate closure flaps, a second intermediate closure flap, and an outer closure flap, all of which are arranged in an overlapping interlocking relation.

IN THE FIGURES

SUMMARY OF THE INVENTION

Figure 1:
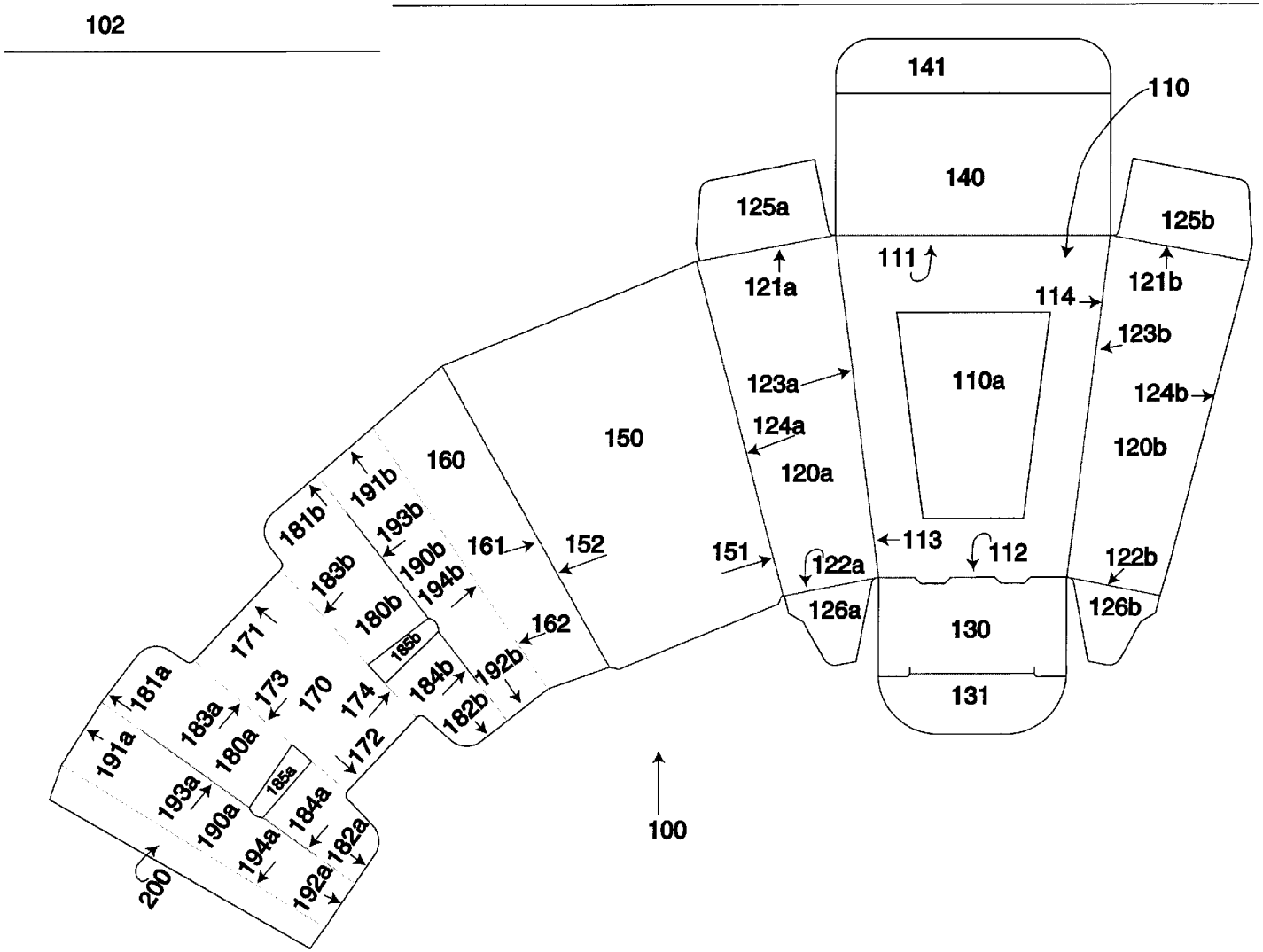
FIG. 1 is a top view of a one piece blank of foldable sheet material constructed in accordance with a preferred embodiment of the present invention. The blank is cut and scored so that it is divided into a series of connected wall forming panels which when assembled provides the inventive one piece trapezoidal carton with an inner partition for packaging an article.

The present invention is directed to a one piece blank of foldable sheet material cut and scored so that it is divided into a series of connected wall forming panels which when assembled provides a trapezoidal carton with an inner partition for packaging an article, wherein the blank comprises:

(A) a trapezoidal carton forming section having:
- (a) a trapezoidal front wall panel having a top, a bottom, and two sides;
- (b) a pair of trapezoidal side wall panels, each having a top, a bottom, and a first and second side, each first side extending from the sides of the front wall panel, with a fold line between each side wall panel and the front wall panel, each side wall panel including a top and bottom closing flap foldably connected to the top and bottom sides, respectively, of the side wall panel for closing the carton;
- (c) a rectangular bottom panel extending from the bottom of the front wall panel, including a bottom closing flap foldably connected to the bottom panel for closing the carton, with a fold line between the bottom panel and the front wall panel;
- (d) a rectangular top panel extending from the top of the front wall panel, including a top closing flap foldably connected to the top panel for closing the carton, with a fold line between the top panel and the front wall panel;
- (e) a trapezoidal back wall panel having a first and second side, wherein the first side of the back wall panel extends from a second side of the side wall panel, with a fold line between the side wall panel and the back wall panel; and
- (f) a trapezoidal glueable side panel having a first and second side, wherein the first side of the glueable side panel extends from the second side of the back wall panel, with a fold line between the glueable side panel and the back wall panel; and (B) an inner partition forming section having:
- (a) a trapezoidal center partition having a top, a bottom, and two sides;
- (b) a pair of trapezoidal cradling partitions, each having a top, a bottom, and a first and a second side, wherein the first side of each cradling partition extends from a side of the center partition, with a fold line between each cradling partition and the center partition; and
- (c) a pair of trapezoidal supporting partitions, each having a top, a bottom, and a first and a second side, wherein the first side of each supporting partition extends from the second side of the trapezoidal cradling partitions, with a fold line between each supporting partition and the cradling partition, and the second side of the one of the trapezoidal supporting partitions is attached to a trapezoidal glueable partition;

wherein the second side of the other trapezoidal supporting partition in (B)(c) of the inner partition forming section is attached to the second side of the trapezoidal glueable side panel in (A)(f) of the trapezoidal carton forming section.

In another embodiment, the invention is directed to a one piece trapezoidal carton with an inner partition for packaging an article comprising:

(A) a trapezoidal carton section having:
- (a) trapezoidal front and back wall panels;
- (b) first and second trapezoidal side wall panels connecting the front and back wall panels;
- (c) a rectangular bottom panel closing the bottom of the carton;
- (d) a rectangular top panel including a top closing flap for closing the top of the carton; and
- (e) a trapezoidal glueable side panel, having a first and second side, attached to the inside of the first side wall panel, wherein the first side of the trapezoidal glueable side panel extends from the back wall panel; and (B) an inner partition section having:
- (a) a trapezoidal center partition;
- (b) a pair of trapezoidal cradling partitions, each extending from a side of the center partition;
- (c) first and second trapezoidal supporting partitions, each extending from a side of one of the trapezoidal cradling partitions; and
- (d) a trapezoidal glueable partition, attached to the inside of the second side wall panel, extending from a side of the second trapezoidal supporting partition;

wherein a side of the first trapezoidal supporting partition in the inner partition section extends from the second side of the trapezoidal glueable side panel in the trapezoidal carton section to form the one piece carton.

DETAILED DESCRIPTION OF THE INVENTION

The invention is directed to a one piece trapezoidal carton with an attached glueable inner partition which serves as a cradling or holding device for keeping a product in place. The attached inner partition eliminates the need for a separate component to hold the product. The trapezoidal carton is prepared from a one piece blank of foldable sheet material cut and scored so that it is divided into a series of connected wall forming panels and inner partitions which when assembled provides the one piece trapezoidal carton with the cradling device. The fold lines between the wall forming panels and inner partitions are located on the radius of a circle.

The invention will be better understood from the following detailed description of the preferred embodiments taken in conjunction with the Figures, in which like elements are represented by like referenced numerals.

In FIG. 1, a one piece blank of foldable sheet material is depicted generally as 100 and constructed in accordance with a preferred embodiment of the present invention. Blank 100 is cut and scored so that it is divided into a series of connected wall forming panels which when assembled provides a one piece trapezoidal carton with an inner partition for packaging an article. Blank 100 comprises a trapezoidal carton forming section 101 and an inner partition forming section 102. The trapezoidal carton forming section 101 has a trapezoidal front wall panel 110 having a top 111, a bottom 112, and two sides, 113 and 114. Trapezoidal carton forming section 101 also has a pair of trapezoidal side wall panels, 120*a* and 120*b*. Each side wall panel, 120*a* and 120*b*, has a top, 121*a* and 121*b*, a bottom, 122*a* and 122*b*, and a first side, 123*a* and 123*b*, and a second side, 124*a* and 124*b*. Each first side, 123*a* and 123*b*, extends from the sides of the front wall panel, 113 and 114, respectively, with a fold line between each side wall panel, 120*a* and 120*b*, and the front wall panel, 110. Each side wall panel includes a top closing flap, 125*a* and 125*b*, and a bottom closing flap, 126*a* and 126*b*, foldably connected to the top and bottom sides, respectively, of the side wall panel for closing the carton. A rectangular bottom panel 130 extends from the bottom of the front wall panel 110 and includes a bottom closing flap 131 foldably connected to the bottom panel for closing the carton, with a fold line between the bottom panel 130 and the front wall panel 110. A rectangular top panel 140 extends from the top of the front wall panel 110 and includes a top closing flap 141 foldably connected to the top panel for closing the carton, with a fold line between the top panel 140 and the front wall panel 110. A trapezoidal back wall panel 150 has a first side 151 and second side 152. The first side of the back wall panel 151 extends from a second side of the side wall panel 124*a*, with a fold line between the side wall panel and the back wall panel. A trapezoidal glueable side wall panel 160 has a first side 161 and second side 162. The first side of the glueable side panel 161 extends from the second side of the back wall panel 152, with a fold line between the glueable side panel and the back wall panel.

Inner partition forming section 102 is attached to the second side of the trapezoidal glueable side panel 162 in the trapezoidal carton forming section 101. Inner partition forming section 102 has a trapezoidal center partition 170 having a top 171, a bottom 172, and two sides, 173 and 174. A pair of trapezoidal cradling partitions, 180*a* and 180*b*, each have *a* top, 181*a* and 181*b*, a bottom, 182*a* and 182*b*, and a first side, 183*a* and 183*b*, and a second side, 184*a* and 184*b*. The first side of each cradling partition, 183*a* and 183*b*, extends from a side of the center partition, 173 and 174, with a fold line between each cradling partition and the center partition. A pair of trapezoidal supporting partitions, 190*a* and 190*b*, each have a top, 191*a* and 191*b*, a bottom, 192*a* and 192*b*, and a first side, 193*a* and 193*b*, and a second side, 194*a* and 194*b*. The first side of each supporting partition, 193*a* and 193*b*, extends from the second side of the trapezoidal cradling partitions, 184*a* and 184*b*, with a fold line between each supporting partition and the cradling partition. The second side of one of the trapezoidal supporting partitions 194*b* is attached to the second side of the trapezoidal glueable side panel 162 of the trapezoidal carton forming section 101. The second side of the other trapezoidal supporting partition 194*a* is attached to a trapezoidal glueable partition 200.

Optionally, at least one trapezoidal cradling partition, 180*a* or 180*b*, may contain a cutout area, 185*a* and 185*b*, for cradling a product. Optionally, the front wall panel 110 or back wall panel 150 may contain a cut out 110*a* for a window. Optionally, the front wall panel 110 or back wall panel 150 may contain a cut out for a hanging strip (not shown).

Figure 2:
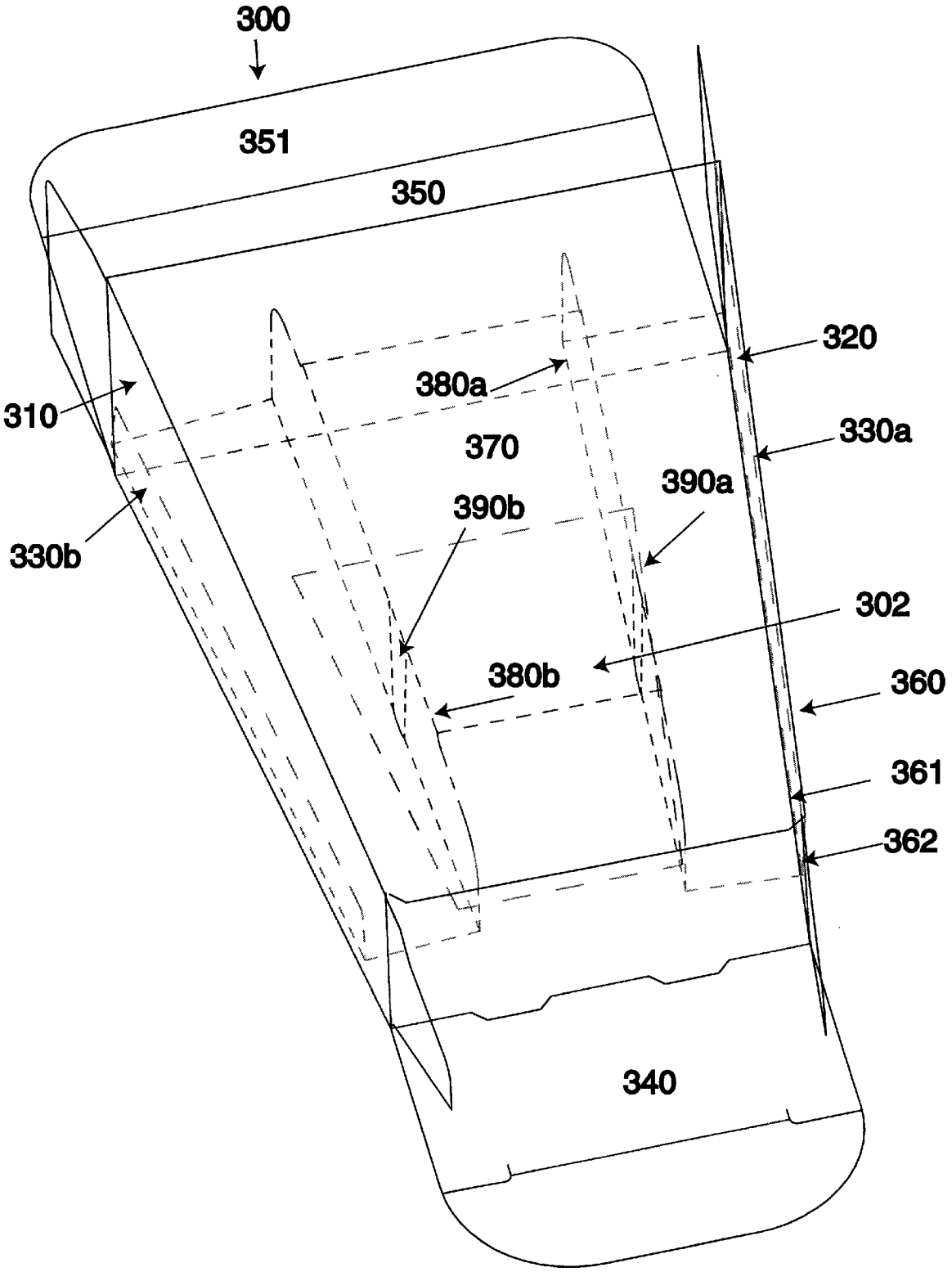
FIG. 2 is a side view of the one piece trapezoidal carton with an inner partition for packaging an article in accordance with the present invention.

In FIG. 2, a one piece trapezoidal carton with an inner partition for packaging an article is depicted generally as 300 and constructed in accordance with a preferred embodiment of the present invention. The one piece trapezoidal carton 300 comprises a trapezoidal carton section 301 and an inner partition section 302. The trapezoidal carton section 301 has a trapezoidal front wall panel 310 and a back wall panel 320. First trapezoidal side wall panel 330*a* and second trapezoidal side wall panel 330*b* connect the front wall panel 310 and back wall panel 320. A rectangular bottom panel 340 closes the bottom of the carton. A rectangular top panel 350 includes a top closing flap 351 for closing the top of the carton. A trapezoidal glueable side panel 360, having a first side 361 and a second side 362, is attached to the inside of the first side wall panel 330*a*. The first side of the trapezoidal glueable side panel 361 extends from the back wall panel 320.

The inner partition section 302 extends from the second side of the trapezoidal glueable side panel 362 in the trapezoidal carton section 301. The inner partition section 302 has a trapezoidal center partition 370. A pair of trapezoidal cradling partitions, 380*a* and 380*b*, each extend from a side of the center partition 370. First trapezoidal supporting partition 390*a* and second trapezoidal supporting partition 390*b* each extend from a side of one of the trapezoidal cradling partitions, 380*a* and 380*b*. A side of the first trapezoidal supporting partition 390*a* extends from the second side of the trapezoidal glueable side panel 362 in the trapezoidal carton section 301. A trapezoidal glueable partition 400 is attached to the inside of the second side wall panel 330*b* and extends from a side of the second trapezoidal supporting partition 390*b*.

Optionally, the trapezoidal center partition 370 may be attached to the front wall panel 310 or back wall panel 320. Optionally, at least one cradling partition, 380*a* or 380*b*, may have a cutout area for cradling a product (not shown). Optionally, the front wall panel 310 or back wall panel 320 may contain a cut out for a window (not shown). Optionally, the front wall panel 310 or back wall panel 320 may contain a cut out for a hanging strip (not shown).

The one piece trapezoidal carton with an inner partition of the present invention for packaging an article includes a trapezoidal carton section and an inner partition section. The cartons can be used with automatic machinery equipment which will erect the carton in the machine and will automatically fill the carton with the article or articles to be packaged. The face of the one piece trapezoidal cartons of the present invention are clean in their original, glued, sealed position.

The trapezoidal carton with an inner partition can be used to accommodate a wide variety of articles or products in different container sizes. While the trapezoidal carton with an inner partition has been shown in connection with certain preferred embodiments as shown, other embodiments of different shapes or locations can be utilized with varying container shapes. In addition, more or less score lines can be added as appropriate to make the trapezoidal carton with an inner partition more flexible for machine insertion of the object to be packaged. In addition, multiple cutouts can be utilized where appropriate for either multiple objects to be held or due to the shape of the object to be held.

The invention being thus described, it will be obvious that the same may be varied in many ways. Such variations are not to be regarded as a departure from the spirit and scope of the invention and all such modifications are intended to be included within the scope of the following claims.

I claim:

1. A one piece blank of foldable sheet material cut and scored so that it is divided into a series of connected wall forming panels which when assembled provides a trapezoidal carton with an inner partition for packaging an article, wherein the blank comprises:

(A) a trapezoidal carton forming section having:

(a) a trapezoidal front wall panel having a top, a bottom, and two sides;

(b) a pair of trapezoidal side wall panels, each having a top, a bottom, and a first and second side, each first side extending from the sides of the front wall panel, with a fold line between each side wall panel and the front wall panel, each side wall panel including a top and bottom closing flap foldably connected to the top and bottom sides, respectively, of the side wall panel for closing the carton;

(c) a rectangular bottom panel extending from the bottom of the front wall panel, including a bottom closing flap foldably connected to the bottom panel for closing the carton, with a fold line between the bottom panel and the front wall panel;

(d) a rectangular top panel extending from the top of the front wall panel, including a top closing flap foldably connected to the top panel for closing the carton, with a fold line between the top panel and the front wall panel;

(e) a trapezoidal back wall panel having a first and second side, wherein the first side of the back wall panel extends from a second side of the side wall panel, with a fold line between the side wall panel and the back wall panel; and (f) a trapezoidal glueable side panel having a first and second side, wherein the first side of the glueable side panel extends from the second side of the back wall panel, with a fold line between the glueable side panel and the back wall panel; and (B) an inner partition forming section having:

(a) a trapezoidal center partition having a top, a bottom, and two sides;

(b) a pair of trapezoidal cradling partitions, each having a top, a bottom, and a first and a second side, wherein the first side of each cradling partition extends from a side of the center partition, with a fold line between each cradling partition and the center partition; and (c) a pair of trapezoidal supporting partitions, each having a top, a bottom, and a first and a second side, wherein the first side of each supporting partition extends from the second side of the trapezoidal cradling partitions, with a fold line between each supporting partition and the cradling partition, and the second side of the one of the trapezoidal supporting partitions is attached to a trapezoidal glueable partition;

wherein the second side of the other trapezoidal supporting partition of the inner partition forming section is attached to the second side of the trapezoidal glueable side panel of the trapezoidal carton forming section.

2. The one piece blank according to claim 1, wherein at least one trapezoidal cradling partition has a cutout area for cradling a product.

3. The one piece blank according to claim 1, wherein one of said front wall panel and back wall panel contains a cut out for a window.

4. A one piece trapezoidal carton with an inner partition for packaging an article comprising:

(A) a trapezoidal carton section having:

(a) trapezoidal front and back wall panels;

(b) first and second trapezoidal side wall panels connecting the front and back wall panels;

(c) a rectangular bottom panel closing the bottom of the carton;

(d) a rectangular top panel including a top closing flap for closing the top of the carton; and (e) a trapezoidal glueable side panel, having a first and second side, attached to the inside of the first side wall panel, wherein the first side of the trapezoidal glueable side panel extends from the back wall panel; and (B) an inner partition section having:

(a) a trapezoidal center partition;

(b) a pair of trapezoidal cradling partitions, each extending from a side of the center partition;

(c) first and second trapezoidal supporting partitions, each extending from a side of one of the trapezoidal cradling partitions; and (d) a trapezoidal glueable partition, attached to the inside of the second side wall panel, extending from a side of the second trapezoidal supporting partition;

wherein a side of the first trapezoidal supporting partition in the inner partition section extends from the second side of the trapezoidal glueable side panel in the trapezoidal carton section to form the one piece carton.

5. The one piece trapezoidal carton according to claim 4, wherein the trapezoidal center partition is attached to one of said front wall panel and back wall panel.

6. The one piece trapezoidal carton according to claim 4, wherein at least one cradling partition has a cutout area for cradling a product.

7. The one piece trapezoidal carton according to claim 4, wherein one of said front wall panel and back wall panel contains a cut out for a window.

* * * * *